United States Patent [19]

Kaiser

[11] 4,171,584

[45] Oct. 23, 1979

[54] SIGN ASSEMBLY

[75] Inventor: Frank C. Kaiser, San Francisco, Calif.

[73] Assignee: Wells Fargo and Company, San Francisco, Calif.

[21] Appl. No.: 802,671

[22] Filed: Jun. 2, 1977

[51] Int. Cl.[2] ..... G09F 7/10

[52] U.S. Cl. ..... 40/490; 40/10 D; 40/16.4; 40/109; 40/597

[58] Field of Search ..... 40/585, 597, 611, 489, 40/490, 491, 375, 10 D, 16, 16.4, 109, 107; 283/18

[56] References Cited

U.S. PATENT DOCUMENTS

| | | | |
|---|---|---|---|
| 561,231 | 6/1896 | Bray | 40/611 |
| 873,824 | 12/1907 | Abbott | 40/611 |
| 2,619,867 | 12/1952 | Frisch | 40/490 |
| 2,990,196 | 6/1961 | Slavsky | 283/18 |
| 3,896,575 | 7/1975 | Silverman | 40/585 |
| 3,914,890 | 10/1975 | Behlen, Jr. | 40/597 |

*Primary Examiner*—John F. Pitrelli

*Attorney, Agent, or Firm*—Flehr, Hohbach, Test, Albritton & Herbert

[57] ABSTRACT

Sign assembly which can be readily set up and changed to display different information. The assembly includes a generally planar body with suction cups for securing the assembly to a mounting surface. Indicia carrying sign cards are removably mounted in slots formed by ribs on the body, and in one preferred embodiment the assembly is packaged as a kit with a number of different sign cards arranged in perforated sheets.

8 Claims, 5 Drawing Figures

FIG-1
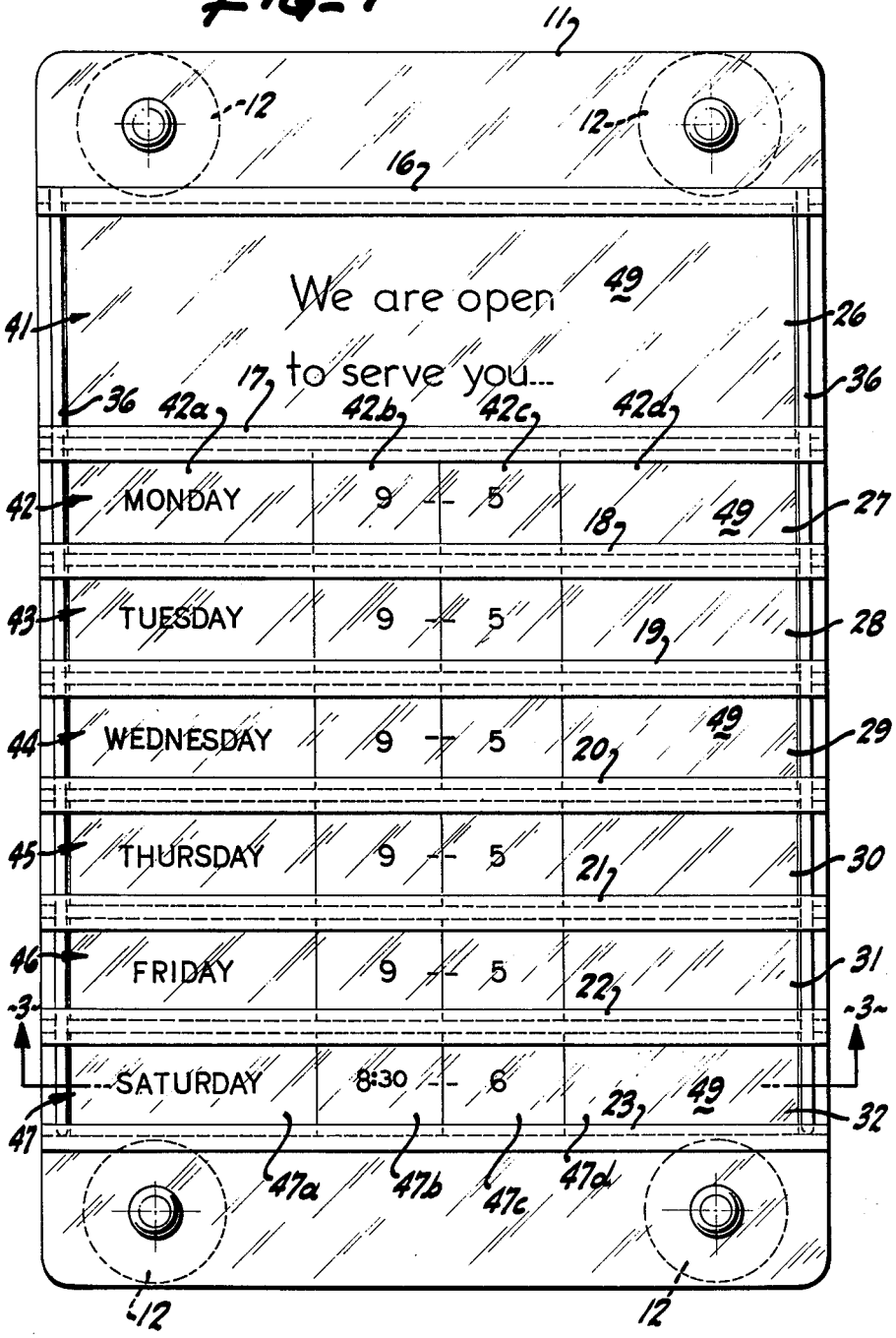
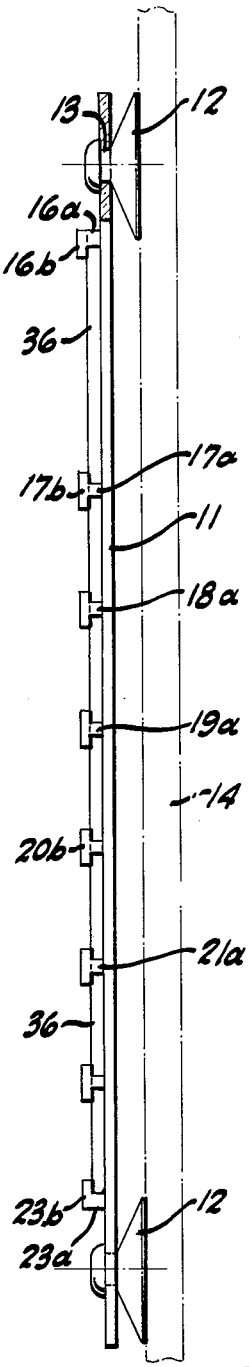
FIG-2
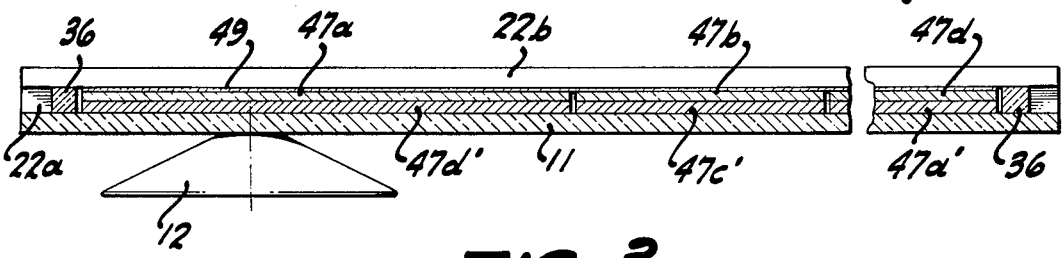
FIG-3

SIGN ASSEMBLY

BACKGROUND OF THE INVENTION

This invention pertains generally to signs and more particularly to signs in which the information display can be set up and changed to suit the user's needs.

Signs of the type utilized, for example, to indicate the hours that offices, stores and other commercial establishments are open for business must generally be custom made to show the hours for each individual business. When the hours change, the sign must be changed or replaced.

SUMMARY AND OBJECTS OF THE INVENTION

The invention provides an attractive sign assembly which can be readily set up and changed to display different information. This assembly includes a generally planar body with a suction cup for securing the assembly to a mounting surface. A plurality of spaced apart ribs extend across one major surface of the body to define slots in which cards bearing the display information are removably mounted. Removable retainer bars extend transversely of the slots to retain the cards in position, and in one preferred embodiment, the assembly is packaged as a kit with the sign cards arranged in perforated sheets.

It is in general an object of the invention to provide a new and improved sign assembly.

Another object of the invention is to provide a sign assembly of the above character in which the display information is readily set up and changed to suit the user's needs.

Additional objects and features of the invention will be apparent from the following description in which the preferred embodiment is set forth in detail in conjunction with the accompanying drawings.

BRIEF DESCRIPTION OF THE DRAWINGS

FIG. 1 is a front elevational view of one embodiment of a sign assembly according to the invention.

FIG. 2 is a side elevational view of the sign assembly of FIG. 1.

FIG. 3 is a cross-sectional view taken along line 33 in FIG. 1.

DESCRIPTION OF THE PREFERRED EMBODIMENT

Figure 4:
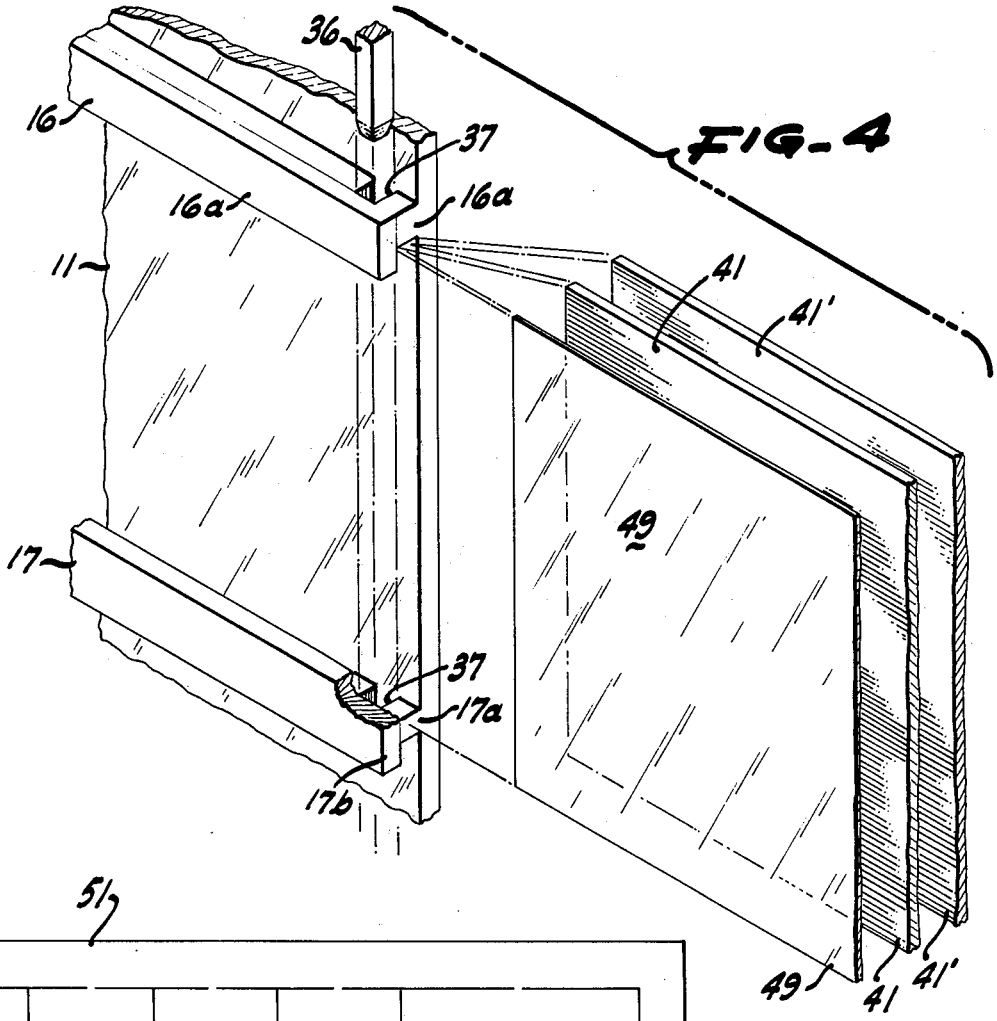
FIG. 4 is an enlarged, fragmentary, exploded perspective view of the sign assembly of FIG. 1.

The sign assembly includes a generally planar, rectangular base panel or body 11 with suction cups 12 mounted in openings 13 toward the corners of the body for releasably securing the assembly to a generally planar mounting surface such as window pane 14. In the preferred embodiment, the body is fabricated of a rigid, transparent material, such as a transparent plastic, and a portion of the information carried by the sign is visible through the body. This arrangement is particularly advantageous when the sign is mounted in a window and the information is to be read from both sides of the window.

A plurality of generally parallel card retaining members in the form of ribs 16–20 extend horizontally across one face or surface 24 of body 11 and define slots 26–32 for holding sign cards carrying the information to be displayed. As illustrated, the cards are arranged in parallel rows distributed over the face of the panel. Each of the ribs includes a base portion, designated by the suffix "a," which extends normally from the body, and a flange portion, designated by the suffix "b," which extends generally parallel to the body along the outer edge of the base portion. As best seen in FIG. 2, the flange portion of the uppermost rib 16 extends downwardly from base portion 16*a*, the flange portion of the lowermost rib 23 extends upwardly from base portion 23*a*, and the flange portions of intermediate ribs 17–22 extend both upwardly and downwardly from base portions 17*a*–22*a*.

Barrier members or retainer bars 36 are removably mounted in vertically aligned openings 37 in the base portions of ribs 16–22 toward the ends of slots 26–32, with the lower ends of the bars resting on the upper surface of the base portion of rib 23. The bars are slidably mounted in the openings and are readily withdrawn to permit sign cards to be inserted into or removed from the slots. When installed, the retainer bars close the ends of the slots and thereby serve to retain the cards in the slots.

Information to be displayed by the sign is printed on cards which are removably mounted in slots 26–32. In the embodiment illustrated, the sign is set up to display business hours, and slot 26 contains a title card 41 which reads "We are open to serve you . . . ". Slots 27–32 contain groups of cards 42–47 which indicate the days of the week and the daily hours of operation. Groups 42–47 contain individual cards disposed side by side, with cards 42*a*–47*a* indicating the days, and cards 42*b*–47*b* and 42*c*–47*c* indicating the hours of opening and closing. Blank cards 42*d*–47*d* are mounted next to closing hour cards 42*c*–47*c*. It will be apparent that the cards can be readily interchanged and replaced to indicate different hours or different information.

In addition to cards 41–47, a second set of similar cards, designated 41'–47', is mounted in the slots and disposed back to back with cards 41–47. Thus, the two sets of cards face and can be read from opposite sides of the sign, with cards 41'–47' being visible through the transparent body 11. Transparent overlays 49 are mounted in the slots adjacent to the faces of cards 41–47.

As illustrated, the height of each card is slightly less than the distance between the body portions of the ribs defining the slot in which the card is mounted, whereby the cards are movable longitudinally of the slots while being retained in the slots by the flange portions of the ribs. The total width of the cards disposed side by side in each slot corresponds to the spacing between ribs 36, and the total thickness of the two sets of cards and the overlay is slightly less than the spacing between the surface of the body and the flange portions of the ribs.

Figure 5:
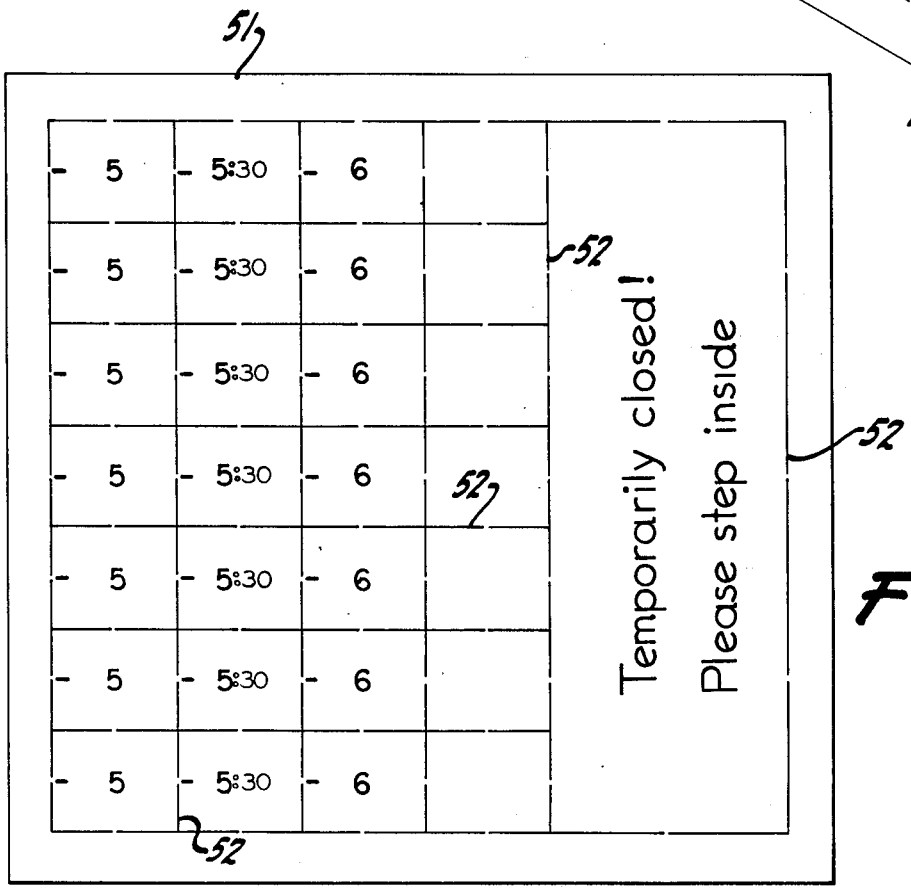
FIG. 5 is a plan view of a perforated sheet containing a plurality of sign cards for use in the sign assembly of FIG. 1.

In one preferred embodiment, the sign assembly is packaged in the form of a kit containing the ribbed body and retainer bars, the transparent overlays, and a plurality of sign cards which can be selectively mounted in the slots to provide the desired message. As illustrated in FIG. 5, the sign cards are packaged in the form of sheets 51. Each sheet comprises a generally rectangular sheet of rigid or semi-rigid material such as cardboard having perforations or lines of weakness 52 defining the boundaries of the cards. The cards can readily be separated along these lines for mounting in the slots to provide the desired message. The cards in each sheet can be imprinted with similar data or different data as desired.

Operation and use of the sign assembly can be summarized briefly as follows. The sign is assembled by removing one or both of the retainer bars 36, separating the desired cards from sheets 51, placing overlays 49 and the selected cards in slots 26–32, and replacing the retainer bars. The cards can be arranged to face either toward or away from the body, or both, as desired. The assembled sign is hung by pressing suction cups 12 against a window glass or other suitable mounting surface.

The sign assembly has a number of important features and advantages. It has an attractive appearance and is readily set up and changed to provide a desired message. This sign can be mounted on a convenient surface, and can be read from both sides when mounted on a transparent surface. The assembly is conveniently packaged in the form of a kit containing a plurality of sign cards from which the user can create the desired message.

It is apparent from the foregoing that a new and improved sign assembly has been provided. While only one presently preferred embodiment has been described, as will be apparent to those familiar with the art, certain changes and modifications can be made without departing from the scope of the invention as defined by the following claims.

What is claimed is:

1. In a window sign assembly: a generally planar transparent body, a suction cup mounted on the body for securing the assembly to the glass in a window, a plurality of generally parallel card retaining members on one surface of the body forming slots for slidably receiving cards in parallel rows distributed over the surface, each of said card retaining members comprising an elongated rib having a base portion extending outwardly from the body and a flange portion extending parallel to the body at the outer edge of the base portion, at least one sign card mounted in each of the slots carrying indicia facing toward and visible through the transparent body, axially aligned openings formed in the base portions of the ribs, and an elongated retainer bar slidably mounted in the openings for closing the ends of the slots to retain the cards therein, said bar being removable from the openings to permit removal of the cards from the slots.

2. The sign assembly of claim 1 wherein the cards carry additional indicia visible from the side of the body away from the window.

3. In a sign kit: a sheet containing a plurality of sign cards having printed material thereon, said cards being individually separable from the sheet, a generally planar body having a plurality of ribs on one surface thereof defining slots for receiving sign cards selected from the sheet in generally parallel rows to display the printed material, each of said ribs having a base portion extending outwardly from the body and a flange portion generally parallel to the surface of the body at the outer edge of the base portion, axially aligned openings formed in the base portions of the ribs, and a retainer bar slidably mounted in the openings for closing the ends of the slots, said bar being removable from the openings to permit the cards to be inserted into and removed from the slots.

4. The sign kit of claim 3 wherein the sheet containing the sign cards comprises a sheet of at least semi-rigid material having lines of weakness along which portions of the sheet can be readily separated to separate the individual cards.

5. The sign kit of claim 3 further including a suction cup for securing the body to a mounting surface.

6. In a display device: a generally planar panel having a plurality of spaced apart generally parallel ribs on one surface thereof, each of said ribs including a base portion extending outwardly from the body and a flange portion generally parallel to the body for receiving display cards slidably inserted between adjacent ones of the ribs, axially aligned openings formed in the base portions of the ribs, and a retainer bar slidably mounted in the openings and serving as a limiting abutment for the cards, said bar being removable from the openings to permit insertion and removal of the cards.

7. The display device of claim 6 wherein the panel is fabricated of a transparent material and information on the cards is visible through the panel.

8. The display device of claim 6 further including a plurality of suction cups affixed to the panel for securing the device to a mounting surface.

* * * * *